US005174309A

United States Patent [19]

Park

[11] Patent Number: 5,174,309

[45] Date of Patent: Dec. 29, 1992

[54] CIGARETTE WITH INSTALLED FIRE EXTINGUISHER

[75] Inventor: Kwang S. Park, Sungnam, Rep. of Korea

[73] Assignee: Wang Sik Shin, Seoul, Rep. of Korea

[21] Appl. No.: 713,745

[22] Filed: Jun. 11, 1991

[30] Foreign Application Priority Data

Jun. 14, 1990 [KR] Rep. of Korea ..... 90-8383

[51] Int. Cl.[5] ..... A24D 1/10

[52] U.S. Cl. ..... 131/337; 131/349; 131/365

[58] Field of Search ..... 131/349, 337, 365

[56] References Cited

U.S. PATENT DOCUMENTS

| | | | |
|---|---|---|---|
| 1,726,737 | 9/1929 | Harris | 131/349 |
| 3,985,143 | 10/1976 | Lappin, Jr. | 131/349 |
| 4,436,101 | 3/1984 | Seatts | 131/337 X |
| 4,979,522 | 12/1990 | Kishida | 131/337 X |

FOREIGN PATENT DOCUMENTS

| | | | |
|---|---|---|---|
| 835923 | 5/1960 | United Kingdom | 131/349 |

*Primary Examiner*—Vincent Millin
*Assistant Examiner*—J. Doyle
*Attorney, Agent, or Firm*—Helfgott & Karas

[57] ABSTRACT

A cigarette includes a cigarette portion, a filter portion and a fire extinguishing portion installed therebetween. The fire extinguishing portion has a doughnut shape cross-section and includes a thinner outer peripheral wall and a thicker inner peripheral wall which are radially spaced from each other to form a water storage therebetween. When a smoker wants to extinguish the light after smoking and presses the fire extinguishing portion by applying thereto a force with his fingers, the outer peripheral wall will be broken and then the stored water will fall over the outer surface of a combustible wrapper material of the cigarette portion towards the lower end of the cigarette so that the light of the cigarette can be timely put out by wetting the end portion of the lit cigarette.

2 Claims, 1 Drawing Sheet

CIGARETTE WITH INSTALLED FIRE EXTINGUISHER

BACKGROUND OF THE INVENTION

1. Field of the Invention

This invention relates to a cigarette in which a fire extinguisher is installed, and more particularly, to a cigarette consisting of a cigarette portion, a filter portion and a fire extinguishing portion installed therebetween. When a smoker wants to extinguish the light after smoking, the filter portion is directed by the smoker upwards and then the fire extinguishing portion is pressed by applying to the cigarette a force with the smoker's fingers. In such a case the surface, i.e., the outer periphery portion of the cigarette will be broken and then the water stored in the cigarette will spill over the outer surface of the combustible wrapper layer of the cigarette portion onto the lower portion so that the light of the cigarette can be timely put out by wetting the end portion of the lit cigarette.

2. Description of the Prior Art

To date, cigarettes which have consisted merely of the cigarette portion and the filter portion have been sold on the market. Also, cigarettes similar to those described above have been on the market. As shown in FIG. 4, such cigarettes include a tube (33) having an injection mouth (34) positioned in a fire extinguishing portion (32) positioned between a cigarette portion (30) and the filter portion (31). The cigarette is wound with a combustible wrapper (35).

However, with such conventional cigarettes, when a smoker wants to extinguish a cigarette he directs the filter portion (31) upwards and presses the fire extinguishing portion (32) with his fingers, and then water which is stored in the tube (33) can wet the inner part of the cigarette portion (30) through the injection mouth (34) while the tube (33) is pressed. Since water can be released only at the portion in which the injection mouth (34) is positioned, the smoker cannot put out the light of the cigarette if he stops smoking before that portion has been reached. Also, when the injection mouth (34) is made rather long, not only is the smoker unable to continue smoking because the stored water is released due to his unconscious burning of the injection mouth (34), but the smoker can also suffer damage due to the inhaling of injurious gas which results from the burning of the injection mouth (34) made of synthetic resin and wood.

Accordingly, it has been a problem with prior art cigarettes that the smoker was not able to timely extinguish the cigarette at any desired point regardless of the length of the cigarette.

SUMMARY OF THIS INVENTION

It is an object of the present invention to provide a cigarette which can be put out by a smoker by wetting a desired portion of the cigarette any time the smoker would want to extinguish the cigarette.

According to the present invention, a cigarette comprises a cigarette portion, a fire extinguishing portion and a filter portion, the extinguishing portion being made of synthetic resin and having the shape "◎" and constituting a water storage portion between an inner periphery wall portion and an outer periphery wall portion thereof. The cigarette portion and one side end of the fire extinguishing portion are connected to each other by winding a combustible wrapper thereabout.

The fire extinguishing portion and the filter portion are wound with a tipping material so as to connect the fire extinguishing portion and the filter portion to each other.

BRIEF DESCRIPTION OF THE DRAWINGS

A better understanding of the invention may be had with reference to the following description in conjunction with the accompanying drawings.

DESCRIPTION OF THE PREFERRED EMBODIMENT

Figure 1:
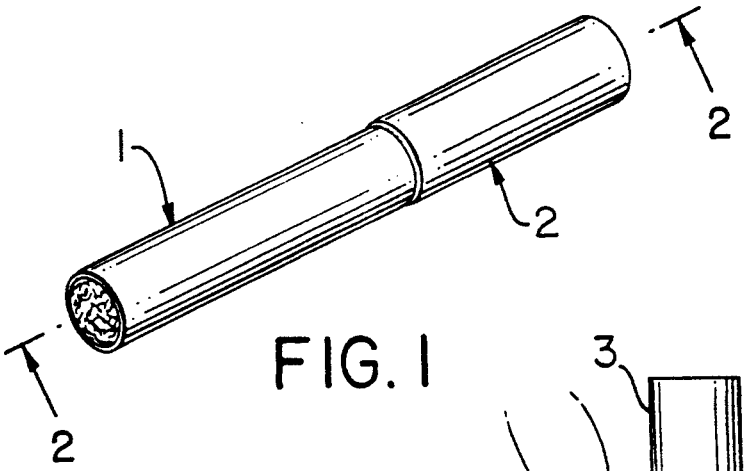
FIG. 1 is a perspective view of a cigarette according to the present invention.
Figure 2A:
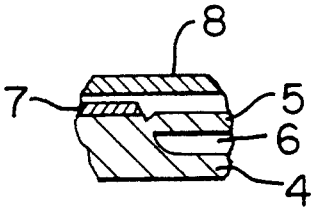
FIG. 2A is an encircled portion of FIG. 2, on enlarged scale.
Figure 3:
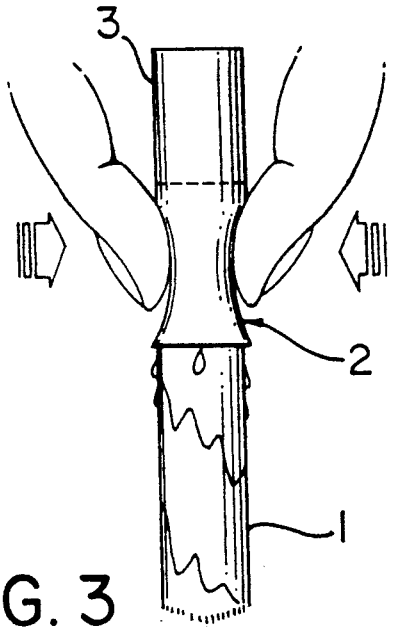
FIG. 3 is a view showing a condition of use of the invention.
Figure 2:
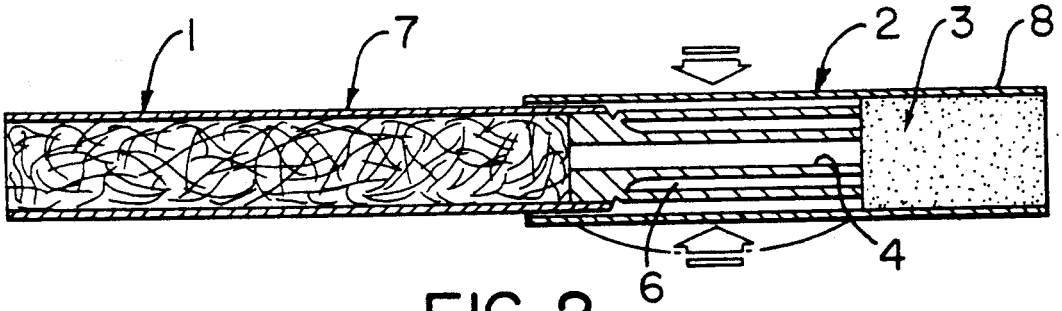
FIG. 2 is a cross-sectional view along lines A—A in FIG. 1.
Figure 4:
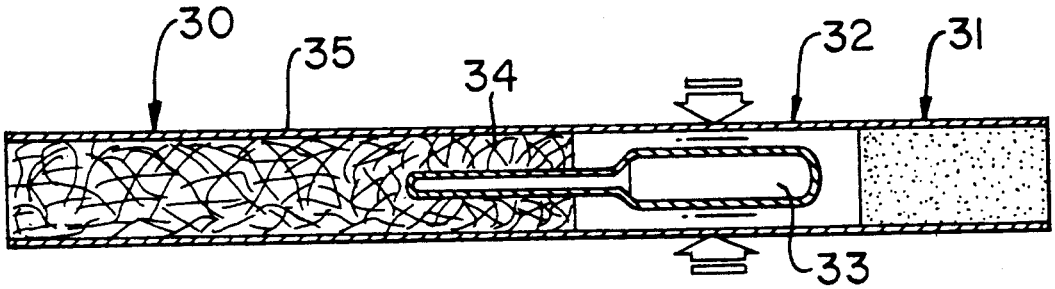
FIG. 4 PRIOR ART
FIG. 4 is a cross-sectional view showing a conventional cigarette.

Referring now to the drawings, and more particularly to FIGS. 1–3 thereof, the cigarette of the present invention includes a cigarette portion (1), a fire extinguishing portion (2) and a filter portion (3). The fire extinguishing portion (2) is made of synthetic resin. A water storage portion (6) is formed between peripheral wall portions 4 and 5 of the fire-extinguishing portion which has a doughnut-shaped cross-section as seen from FIGS. 2 and 2A. A combustible tipping or wrapper material (7) is wound about the cigarette portion (1) and an end portion of the fire extinguishing portion (2). A further tipping material (8) is wound about the filter portion (3), the fire extinguishing portion (2) and the end of the cigarette portion (1) having the material (7) wrapped thereabout. When a smoker wishes to extinguish a cigarette, the filter portion (3) is directed upwards as shown in FIG. 3 and then the fire extinguishing portion (2) at the side of the tipping material (8) is pressed by the smoker's fingers so that the outer periphery wall portion (5) of the fire extinguishing portion 2 may be broken. The outer periphery wall portion (5) may include a V-shaped groove (9), as shown in FIG. 2A, so as to easily break in spite of a slight pressure applied thereto. The outer periphery wall portion (5) is thinner than the inner periphery wall portion (4) so that only the outer periphery wall portion (5) breaks in spite of a constant pressing force applied to portion (2), as shown in FIG. 3.

Therefore, when the outer periphery wall portion (5) of the fire extinguishing portion (2) is broken, a fixed quantity of water stored in the water storage portion (6) will run down. At this time, the run-down water is not absorbed by the tipping material (8) and runs downwardly into the lower portion on the outer periphery of the combustible wrapping material (7) of the cigarette portion (1). In this structure, the cigarette portion (1) and the fire extinguishing portion (2) are completely sealed by the combustible wrapping material (7) and the unbroken portion of the fire extinguishing portion (2), that is, only the end portion of the fire extinguishing (2) and the filter portion (3) are connected to each other by the tipping material (8) wound thereabout. Furthermore, the face of the cigarette portion (1) which is not covered with the tipping material (8) and which is positioned on the outer periphery of the combustible wrapping material (7) wrapped about the fire extinguishing portion (2) and the cigarette portion (1), will be cracked, when the outer periphery wall portion (5) will be broken so that water will run down along the outer periphery of the combustible wrapping material (7) through a crack.

When a smoker sucks in to smoke the cigarette, the tobacco fumes reach the filter portion (3) through an aperture (10) in the inner periphery wall portion (4) of the fire extinguishing portion (2), thereby causing no obstacle in the cigarette function.

Also, in the external appearance of the cigarette, though the extinguishing portion (2) and the filter portion (3) appear to be thicker than the cigarette portion (1) as shown in the Figures, in fact, the cigarette of the present invention is produced and sold with the tipping material (8) being very thin so that no difference in the diameters of the fire extinguishing portion (2), the filter portion (3) and the cigarette portion (1) can be observed.

As stated above, according to this invention, when a smoker wants to extinguish a cigarette, the water runs down into the end portion of the cigarette which is lit, so that the light of the cigarette can be put out timely as desired and the occurrence of fire and poisonous gas would be prevented. Accordingly, this invention is deemed to be a practical device suitable for mass production.

What is claimed is:

1. A cigarette comprising an elongated cigarette portion; a fire extinguishing portion connected at one end thereof to said cigarette portion; a filter portion connected to another end of said fire extinguishing portion, said fire extinguishing portion being made of synthetic resin and having of a substantially doughnut-shaped cross-section and including an outer peripheral wall portion and an inner peripheral wall portion radially spaced from each other to form a water storage therebetween; a combustible wrapping material portion wound about said cigarette portion along an entire length thereof and about an end portion of said fire extinguishing portion so as to connect said cigarette portion to said fire extinguishing portion; and a tipping material portion wound about said filter portion and said fire extinguishing portion along an entire length thereof to connect said filter portion to said fire extinguishing portion, said tipping material portion overlapping an end portion of said cigarette portion having said wrapping material portion would thereabout.

2. A cigarette according to claim 1, wherein said outer peripheral wall portion is thinner than said inner peripheral wall portion so that, upon pressing said fire extinguishing portion with user's fingers, said outer peripheral portion becomes broken to release water from said water storage onto said cigarette portion.

* * * * *